US007748291B2

(12) United States Patent
Pages et al.

(10) Patent No.: US 7,748,291 B2
(45) Date of Patent: Jul. 6, 2010

(54) CAM FOLLOWER ARM FOR A MOUNTING MECHANISM COMPRISING SAID LEVER AND WEAVING MACHINE FITTED WITH SAID MECHANISM

(75) Inventors: Jean-Pierre Pages, Faverges (FR); Bastien Tardy, Annecy (FR)

(73) Assignee: Staubli Faverges, Faverges (FR)

( * ) Notice: Subject to any disclaimer, the term of this patent is extended or adjusted under 35 U.S.C. 154(b) by 814 days.

(21) Appl. No.: 10/593,047

(22) PCT Filed: Mar. 25, 2005

(86) PCT No.: PCT/FR2005/000724

§ 371 (c)(1),
(2), (4) Date: Sep. 15, 2006

(87) PCT Pub. No.: WO2005/098106

PCT Pub. Date: Oct. 20, 2005

(65) Prior Publication Data

US 2008/0236330 A1 Oct. 2, 2008

(51) Int. Cl.
*D03C 5/02* (2006.01)

(52) U.S. Cl. ..... 74/569; 74/54; 74/567; 139/58; 139/66 R; 139/79

(58) Field of Classification Search ..... 74/53, 74/54, 567, 569; 139/58, 66 R, 66 A, 67–77, 139/79; 403/374.5
See application file for complete search history.

(56) References Cited

U.S. PATENT DOCUMENTS

| | | | | | |
|---|---|---|---|---|---|
| 3,946,766 | A | | 3/1976 | Amigues | 139/66 R |
| 3,986,529 | A | * | 10/1976 | Pfarrwaller | 139/79 |
| 4,481,839 | A | * | 11/1984 | Zullo et al. | 74/569 |
| 4,716,939 | A | | 1/1988 | Palau | 139/79 |
| 5,251,672 | A | * | 10/1993 | Froment et al. | 139/82 |

FOREIGN PATENT DOCUMENTS

| | | |
|---|---|---|
| EP | 0255266 | 12/1985 |
| FR | 2317395 | 8/1975 |
| JP | 7243146 | 1/1996 |

* cited by examiner

*Primary Examiner*—Richard W L Ridley
*Assistant Examiner*—Thomas Diaz
(74) *Attorney, Agent, or Firm*—Dowell & Dowell, PC

(57) ABSTRACT

The lever (11) is fitted with two rollers (20A, 20B) which are supported by a core (21) provided with a mounting bore (21B) on an articulated shaft, wherein the rollers (20A, 20B) are both mounted between two webs of a pair of webs which are added to the core (21). The webs (22A, 23B) are on the whole planar. A first web (22A) of each pair of webs is partially engaged in a hollow housing (21C) created on the lateral surface (21D) of the core (21). The second web (23B) of the same pair is maintained at a distance from the first web. The hollow housings (21C) are created on the two opposite lateral surfaces (21D) of the core (21) of the lever (11).

7 Claims, 2 Drawing Sheets

CAM FOLLOWER ARM FOR A MOUNTING MECHANISM COMPRISING SAID LEVER AND WEAVING MACHINE FITTED WITH SAID MECHANISM

BACKGROUND OF THE INVENTION

1. Field of the Invention

The present invention relates to a cam follower lever used in a cam weave mechanism and to a method of manufacturing such a lever. The invention also relates to a cam weave mechanism comprising such a lever and a loom fitted with such a mechanism.

2. Brief Description of the Related Art

In the field of looms, cam weave mechanisms are known that comprise a series of oscillating levers in numbers equal to those of the heddle frames to be mounted on the looms, each oscillating lever being designed to be coupled to one of the frames and fitted with two rollers which interact with two tracks of a complementary cam rotated by a common shaft. The twin tracks of one and the same cam are offset axially and the rollers supported by the associated lever must have the same axial offset as the tracks of the cam.

To do this, it is known practice, for example from EP-A-0 225 266, to mount the rollers of a lever protruding either side of a core. This generates twisting or overhanging moments on the shafts that support the rollers, which induces flexings, mechanism fatigues, even breakages of these elements and a loss of precision during operation. EP-A-0 225 266 also proposes to mount the rollers of a lever in grooves machined in solid cores that are relatively thick. Such a technique is extremely costly, particularly because the core of the lever is relatively voluminous.

Furthermore, it is a known practice from FR-A-2 317 395 to produce a lever formed essentially of two flanges provided with steps. It is also known from FR-A-2 259 173 to mount the rollers of a lever in a yoke between two pairs of flanges that are cambered and mounted in opposition. The steps and cambers of the main portions of the flanges of the known levers are supposed to make it possible to compensate for the offset between the rollers and the mid-plane of the lever. In practice, they are subjected to flexing forces that are too high for the metal sheets forming them, which causes them to deform and even break.

SUMMARY OF THE INVENTION

It is these disadvantages that the invention proposes more particularly to remedy by proposing a new cam follower lever which allows an axial offset of the rollers, in order to allow their alignment with the twin tracks of a complementary cam, and in which it is not necessary to provide steps or cambers likely to deform under load.

With this in mind, the invention relates to a lever with cam followers of a cam weave mechanism, this lever being fitted with two rollers supported by a core, while these rollers are each mounted between two flanges of a pair of flanges fitted to this core, characterized in that these flanges are globally flat, in that a first flange of each pair of flanges is partially engaged in a recessed housing made on a lateral face of this core while the second flange of the same pair is held at a distance from the first, and in that the recessed housings provided for the first flanges of the two pairs of flanges are made on the two opposite lateral faces of the core of the lever.

Thanks to the invention, the axial offset of the two cam followers of the lever is obtained by an appropriate positioning of the recessed housings made on the core of the lever, while the flanges that are globally flat do not risk deforming at a camber or a step.

According to a first embodiment of the invention, a spacer for the spacing of the second flange and of the core may be provided. According to another embodiment, the second flange is provided with a heel for pressing on the core of the lever, this heel making it possible to hold a main portion of the second flange at a distance from a main portion of the first. According to another embodiment, it is the core itself that is provided with at least one heel for pressing on the second flange, this heel also making it possible to hold the main portions of the flanges at a distance.

Irrespective of the embodiment considered, the respective mid-planes of the rollers are parallel, situated either side of and substantially at equal distances from the mid-plane of the core of the lever.

According to another advantageous aspect of the invention, each roller can be mounted about its respective articulation shaft by means of a roller bearing whose rolling elements are held in position by means of two plates placed either side of this shaft, between this shaft and each of the flanges of one and the same pair, these plates extending radially, from this shaft, at least to the rolling elements of the bearing, a portion of the shaft and the plates forming a stack immobilized between the flanges.

The invention also relates to a method of manufacturing a lever with cam followers as previously described and, more specifically, to a method that comprises steps consisting in:

a) mounting two pairs of two globally flat flanges onto the core of the lever with no bore, partially engaging one flange of each pair in a recessed housing made in a lateral face of this core,
b) immobilizing the flanges on this core, particularly by riveting, then
c) drilling bores for an articulation shaft of a cam follower to pass into each pair of flanges,
d) engaging a roller and, where necessary, a portion of its articulation shaft between the two flanges of each pair, and
e) installing and immobilizing relative to these flanges all or a portion of the shafts for articulating the rollers on the lever.

According to an optional feature, provision may be made to interpose a separating spacer between another flange of each pair and the core of the lever. It is also possible to provide that, during step d, the user engages, between the flanges, plates for laterally holding rolling elements forming a bearing between the roller and its articulation shaft.

The invention also concerns a cam weave mechanism that comprises at least one lever as described hereinabove or manufactured according to the method described hereinabove. Such a mechanism may operate at a higher speed and be more reliable than those of the prior art because its cam follower levers do not risk deforming, including under load and at high speed.

The invention relates finally to a loom fitted with a weave mechanism as mentioned hereinabove, such a loom being easier to use than the known looms.

BRIEF DESCRIPTION OF THE DRAWINGS

The invention will be better understood and other advantages of the latter will appear more clearly in light of the following description of three embodiments of a roller lever and of a weave mechanism complying with its principle, and a method of manufacturing such a lever, given solely as an example and made with reference to the appended drawings in which.

DESCRIPTION OF THE PREFERRED EMBODIMENTS

Figure 1:
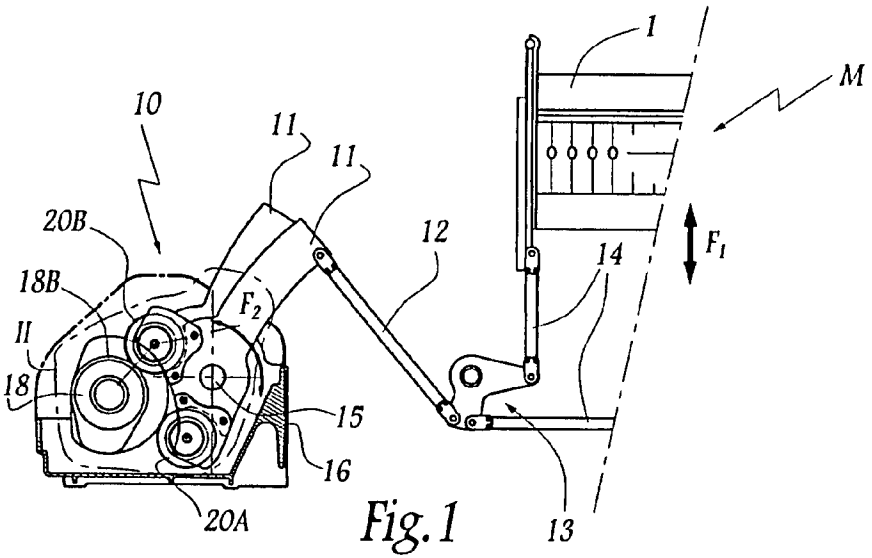
FIG. 1 is a partial schematic representation of the principle of a loom according to the invention.

The loom M shown in FIG. 1 comprises several heddle frames only one of which is shown in FIG. 1. The various frames of the loom M operate in a vertical oscillation movement shown by the double arrow $F_1$ and imparted by a cam mechanism 10 whose output levers 11 act respectively on connecting rods 12 associated with bent levers 13 connected together and to the frame 1 by connecting rods 14.

The levers 11 are provided in a number equivalent to the number of heddle frames 1 and mounted so as to pivot, as shown by the double arrow $F_2$, about a common shaft 15 held by the frame 16 of the mechanism 10 and protected by a cap 17 shown in dot-and-dash lines.

The mechanism 10 also comprises several complementary cams only one of which is shown with reference number 18 and which each define two twin tracks 18A and 18B on which press respectively two rollers 20A and 20B supported by a lever 11.

Each lever 11 comprises a steel core 21 which forms an extension 21A to which one of the connecting rods 12 is coupled. The core 21 also defines a bore 21B for mounting onto the shaft 15. This bore must be defined precisely in order to allow an appropriate positioning of the lever 11 relative to its environment.

One denotes $P_{21}$ the mid-plane of the core 21 at the extension 21A and of the bore 21B. To interact effectively with the tracks 18A and 18B of the cam 18, the rollers 20A and 20B must have their respective mid-planes $P_{20A}$ and $P_{20B}$ placed either side of the plane $P_{21}$. The mid-planes $P_{20A}$ and $P_{20B}$ are planes perpendicular to the axes of rotation $X_{20A}$ and $X_{20B}$ of the rollers 20A and 20B and situated at equal distances from the sides of these rollers. To support the roller 20A, the core 21 is fitted with two flanges 22A and 23A forming a pair placed either side of the roller 20A and of the core 21.

To allow the distribution of the mid-planes of the rollers relative to that of the core 21, the flange 22A that is globally flat is partially engaged in a depression 21C made on the lateral face 21D of the core 21 opposite to that of the side on which lies the mid-plane $P_{20A}$ relative to the mid-plane $P_{21}$. The depression 21C is formed in the thickness of the core 21 and makes it possible to receive a portion of the flange 22A whose edge 22A1 has substantially the same geometry as the edge 21C1 of the depression 21C, which helps the positioning of the flange 22A when the lever 11 is assembled and confers much rigidity to the assembly.

The flange 23A is placed on the opposite side of the flange 22A relative to the roller 20A and is held away from the flange 22A by a packing piece or spacer 24A inserted between the flange 23A and the lateral face 21F of the core 21 opposite to the face 21D.

Thus, because the flange 22A is partially engaged in the depression 21C, the flanges 22A and 23A, that are flat, define between them a volume with a thickness E for receiving the roller 20A offset relative to the mid-plane $P_{21}$ of the core 21. The roller 20A is slightly thinner than the value of E.

In the same manner, the roller 20B is housed between two flanges 22B and 23B of a pair of flanges mounted either side of the core 21, the flange 22B being partially engaged in a depression 21G made in the thickness of the core 21 on the side of the face 21F. A packing piece-spacer 24B makes it possible to hold the flange 23B at a distance from the face 21D and from the flange 22B, which makes it possible to define a housing to receive the roller 20B offset relative to the plane $P_{21}$ opposite to the housing for receiving the roller 20A.

Since the flanges 22A, 22B, 23A and 23B are flat, they have no special deformation zone and have sufficient rigidity to effectively hold the rollers 20A and 20B after having been riveted to the core 21 by means of rivets 26. When the flanges are riveted, the spacers 24A and 24B are sandwiched between the core 21 and the flanges 23A and 23B respectively.

Because of the geometry of the flanges and the distribution of the depressions 21C and 21G, the mid-planes $P_{20A}$ and $P_{20B}$ are parallel, situated either side of the plane $P_{21}$ and substantially at equal distances from the latter.

Figure 4:
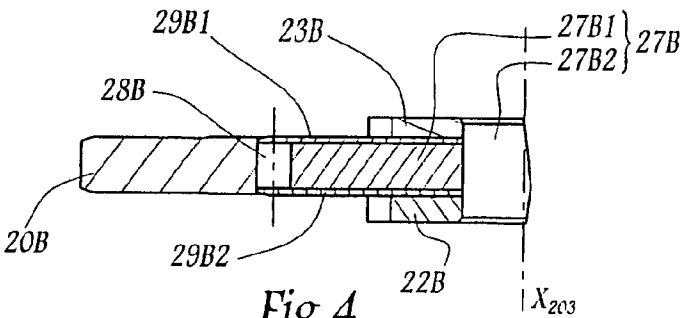
FIG. 4 is a view on a larger scale of detail IV in FIG. 3, the cam being omitted.
Figure 3:
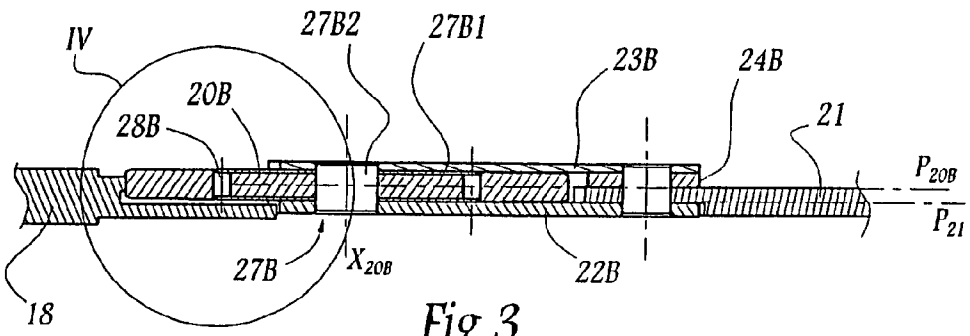
FIG. 3 is a partial section along the line III-III in FIG. 2.
Figure 5:
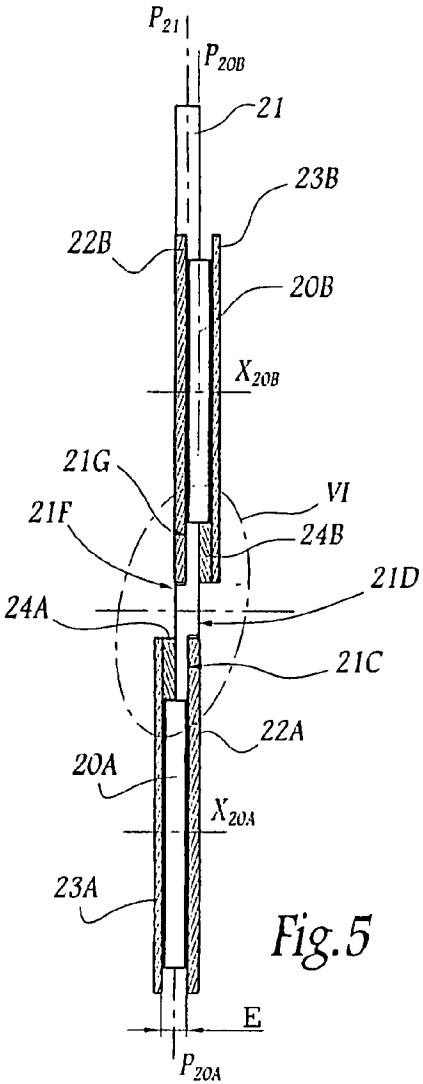
FIG. 5 is a section of the lever along the line V-V in FIG. 2.

As can be seen from particularly FIGS. 3 and 4, the roller 20B consists of a ring mounted above a composite fixed shaft 27B that is formed of an annular piece 27B1 and a rivet 27B2 to immobilize the piece 27B1 relative to the flanges 22B and 23B. Between the elements 20B and 27B1, rolling elements 28B are placed forming a bearing allowing the roller 20B to rotate with little friction.

To hold the rolling elements 28B in place relative to the elements 20B and 27B1, two plates 29B1 and 29B2 are provided placed either side of the piece 27B1 between this piece and the flanges 22B and 23B respectively, these plates extending radially at least to the rolling elements 28B, which provides good stability of the bearing formed by these rolling elements, while the flanges 22B and 23B do not overlap the rolling elements in a zone of the roller that is provided to be engaged between certain portions of the cam 18, as can be seen from FIG. 3.

Attaching the rivet 27B2 thus makes it possible to create, with the elements 22B, 23B, 29B1, 29B2 and 27B1, a fixed and robust structure making it possible to support, guide and rotate the rolling elements 28B and the roller 20B.

Figure 2:
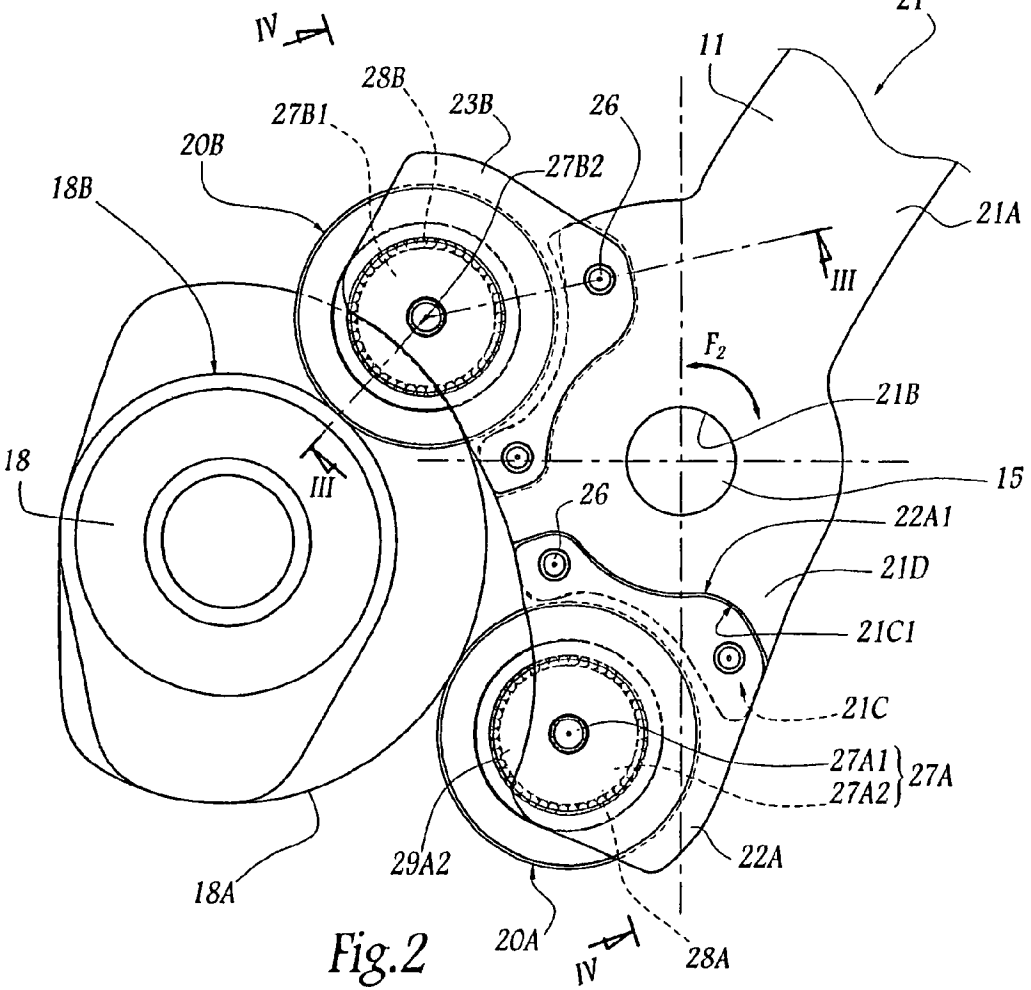
FIG. 2 is a view on a larger scale of detail II in FIG. 1.

In the same manner, the rolling elements 28A are placed between the rollers 20A and an annular piece 27A1 belonging to its articulation shaft 27A and immobilized between the flanges 22A and 23A by means of a rivet 27A2. Holding plates, of which only one is visible in FIG. 2 with reference number 29A2, make it possible to hold the rolling elements 28A in place, including in the portion of the bearing thus formed which protrudes from the volume comprised between the flanges 22A and 23A.

The lever 11 is manufactured by creating a preform of the core 21 that substantially conforms to the finished piece. The flanges 22A, 23A, 22B and 23B are then mounted onto the core 21 in the positions indicated hereinabove. It is then possible to drill in the flanges 22A, 23A, 22B and 23B bores for the rivets 27A2 and 27B2 to pass through. It may be possible then to finish the previously rough-machined bore 21A. This is why the relative position of these bores is defined precisely and takes account of any mounting inaccuracies of the flanges on the core 21.

After drilling these bores, it is possible to insert between each pair of flanges a roller 20A or 20B previously associated with an annular piece 27A1 or 27B1 and with the rolling elements forming a bearing 28A or 28B, these rolling elements being held in position by the retainer plates 29A1, 29B1 and 29B2 placed either side of the annular pieces. The composite structure thus created is moved between the flanges of each pair of flanges to align the central drillhole of the annular piece with the bore made in the flanges, which then makes it possible to install the rivets 27A2 and 27B2.

This mounting method is particularly simple and rapid and makes it possible to obtain a precise positioning of the roller rotation shafts relative to one another and relative to the core of each lever.

Figure 6:
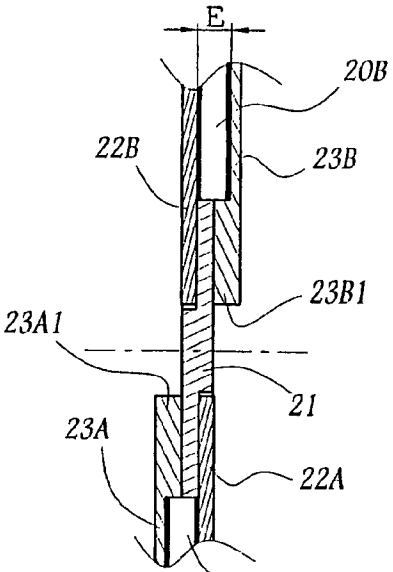
FIG. 6 is a view similar to detail VI in FIG. 5, although on a larger scale, for a lever complying with a second embodiment of the invention

In the second embodiment of the invention shown in FIG. 6, the elements similar to those of the first embodiment bear identical reference numbers. This embodiment differs from the preceding embodiment in that no spacer is provided but in that each flange 23A and 23B is provided with a heel 23A1 or 23B1 which makes it possible to maintain a sufficient spacing E between the flanges 22A and 23A on the one hand, and 22B and 23B on the other hand, such that the rollers 20A and 20B are offset either side of the mid-plane $P_{21}$ of the core 21. The flanges 23A and 23B may be considered globally flat because they are flat on the larger portion of their surface that faces the rollers 20A and 20B.

Figure 7:
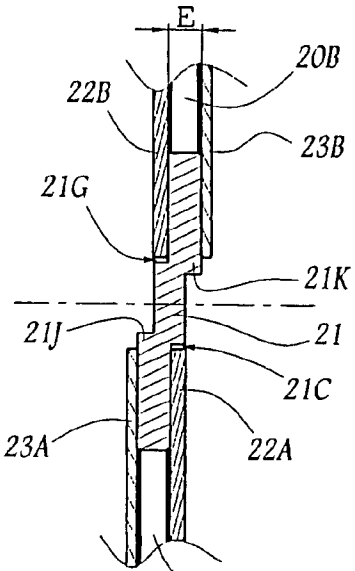
FIG. 7 is a view similar to FIG. 6 for a lever complying with a third embodiment of the invention.

In the third embodiment of the invention shown in FIG. 7, the elements similar to those of the first embodiment bear identical reference numbers. This embodiment differs from the preceding embodiment in that heels 21J and 21K are made on the core 21 and are made in a single piece with the latter, the flat flanges 23A and 23B pressing respectively against these heels, while the flanges 22A and 22B are partially inserted into depressions 21C and 21G made at the same level as the heels and on the faces opposite to the latter.

As in the first two embodiments, the depressions 21C and 21G are made on two opposite faces 21D and 21F of the core 21, the heels 21J and 21K also being made on these two opposite faces. As hereinabove, the heels 21J and 21K make it possible to maintain a sufficient spacing E between the flanges 22A and 23A on the one hand, and 22B and 23B on the other hand.

The levers of the second and third embodiments may be assembled according to a method similar to that described in relation to the first embodiment.

Irrespective of the embodiment in question, the flanges may have the same thickness or different thicknesses.

The invention claimed is:

1. A lever mechanism with cam followers of a cam weave mechanism, the lever mechanism comprising, a lever including a core having a bore for mounting on a shaft, the core including oppositely oriented faces each having a depression formed therein such that the depressions are oriented in opposite directions and at different angular orientations relative to the bore, two pair of opposing flanges for mounting two rollers in spaced relationship to one another and to the core, a flat portion of a first flange of each pair of opposing flanges being seated within one of the opposing depressions of the core while the second flange of the same pair is mounted at a distance (E) from the first flange so as to define a space there between, and means for rotatably mounting one of the rollers in the space between each of the pairs of opposing flanges.

2. The lever mechanism as claimed in claim 1, wherein the second flange of each pair of flanges is spaced from an adjacent face of the core by a spacer whereby the first flange is spaced from the second flange by the distance (E).

3. The lever mechanism as claimed in claim 1, wherein each second flange is provided with a heel for pressing on an adjacent face of the core, the heel spacing the second flange at the distance (E) from the first flange.

4. The lever mechanism as claimed in claim 1, wherein the core is provided with at least one heel for spacing the first and second flanges of at least one pair of flanges at the distance (E).

5. The lever mechanism as claimed in claim 1, wherein respective mid-planes ($P_{20A}$, $P_{20B}$) of said rollers are parallel, situated either side of and substantially at equal distances from a mid-plane ($P_{21}$) of said core and are perpendicular to axes of rotation ($X_{20A}$, $X_{20B}$)of the two rollers and are at equal distances from the sides of the two rollers.

6. The lever mechanism as claimed in claim 1, wherein each means for rotatably mounting each roller between a pair of first and second flanges includes a fixed shaft, a roller bearing mounted about each shaft, each roller bearing including rolling elements held in position by two plates placed either side of the shaft, between each shaft and each of the flanges of the same pair, the plates extending radially, from the shaft, at least to the rolling elements, and a portion of the shaft and the plates forming a stack immobilized between the flanges.

7. A cam weave mechanism, including at least one lever mechanism as claimed in claim 1.

* * * * *